US005419252A

United States Patent [19]

Satake

[11] Patent Number: 5,419,252

[45] Date of Patent: May 30, 1995

[54] VERTICAL MILLING MACHINE

[75] Inventor: Satoru Satake, Tokyo, Japan

[73] Assignee: Satake Corporation, Tokyo, Japan

[21] Appl. No.: 294,321

[22] Filed: Aug. 23, 1994

[51] Int. Cl.[6] ..... B02B 3/00; B02B 3/04; B02B 7/02

[52] U.S. Cl. ..... 99/519; 99/524; 99/606; 99/611; 99/615

[58] Field of Search ..... 99/488, 518–520, 99/521, 522, 524, 525, 528, 600–611, 612–615, 617, 619, 620, 622; 241/7, 57, 58, 74, 257.1, 260.1; 426/481–483

[56] References Cited

U.S. PATENT DOCUMENTS

| | | | |
|---|---|---|---|
| 2,618,307 | 11/1952 | Keller | 99/606 |
| 3,485,280 | 12/1969 | Satake | 146/290 |
| 3,734,752 | 5/1973 | Headley | 99/233.3 |
| 3,960,068 | 6/1976 | Salete | 99/606 |
| 4,292,890 | 10/1981 | Salete-Garces | 99/603 |
| 4,426,922 | 1/1984 | Yamamoto | 99/519 |
| 4,459,903 | 7/1984 | Yamamoto | 99/519 |
| 4,829,893 | 5/1989 | Satake | 99/603 |
| 4,843,957 | 7/1989 | Satake | 99/519 |
| 5,048,407 | 9/1991 | Salete-Garces | 99/519 |
| 5,209,158 | 5/1993 | Salete | 99/615 |
| 5,259,303 | 11/1993 | Yamamoto et al. | 99/524 |
| 5,295,629 | 3/1994 | Satake et al. | 241/57 |

FOREIGN PATENT DOCUMENTS

| | | | |
|---|---|---|---|
| 6-106080 | 4/1994 | Japan | 99/600 |

*Primary Examiner*—Timothy F. Simone
*Attorney, Agent, or Firm*—Darby & Darby

[57] ABSTRACT

A vertical milling machine comprises a first milling part and a second milling part situated under the first milling part, the first and second milling parts having a common main shaft extending vertically. The first milling part has a supply part of grain on an upper end side thereof and a discharge pare of grain having been milled in the first milling part on a lower end side thereof. The second milling part has a supply part of grain to be milled in the second milling part on a lower end side thereof and a discharge part of grain having been milled in the second milling part on an upper end side thereof. The grain discharge part of the first milling part is communicated with the grain supply part of the second milling part through a grain transfer passage extending therebetween. Thus, degree of milling (degree of whitening) in the first and second milling parts can be adjusted individually without difficulty by provision of resistance means individually with respect to the discharge parts of the first and second milling parts.

5 Claims, 4 Drawing Sheets

VERTICAL MILLING MACHINE

BACKGROUND OF THE INVENTION

1. Field of the Invention

The present invention relates to a vertical milling machine comprising a first milling part and a second milling part.

2. Description of Related Arts

Heretofore, there have been known milling machines of the type that two or more milling rolls or whitening rolls are mounted on one main shaft. For example, U.S. Pat. No. 3,485,280 discloses a horizontal milling machine 81 shown in FIG. 5. In this milling machine 81, starting from the right and going to the left in FIG. 5, a screw roll 83, an abrasive milling or whitening roll 84, an intermediate screw roll 85 and a friction type milling roll 86 are mounted on a horizontal main shaft 82 in order. Around the abrasive milling roll 84 is disposed an annular wire mesh bran discharge member or bran-removing, perforated cylindrical body 87 which cooperates with the abrasive milling roll 84 to form an annular abrasive milling chamber 88, while around the friction type milling roll 86 is disposed an annular wire mesh bran discharge member or bran-removing, perforated cylindrical body 89 which cooperates with the friction type milling roll 86 to form an annular friction milling chamber 90. The abrasive milling chamber 88 is communicated at one end (right end in FIG. 5) thereof with a supply port 91 of the milling machine 81, while the friction milling chamber 90 is communicated at one end (left end in FIG. 5) thereof with a discharge port 92 of the milling machine 81. A feed hopper 93 is provided at the supply port 91, and a resistance board 94 is provided at the discharge port 92. To the resistance board 94 is attached a weight 95 for adjusting pressing force exerted thereby.

According to the conventional milling machine 81 shown in FIG. 5, milling is performed in the following manner.

As grains to be milled are supplied from the feed hopper 93 to the vicinity of the screw roll 83 through the supply port 91, the grains are forwarded generally horizontally by the screw roll 83 and, in the abrasive milling chamber 88, milled under the milling or whitening action by the abrasive milling roll 84 which is being rotated. The grains having been milled in the abrasive milling chamber 88 are forwarded to the friction milling chamber 90 by the intermediate screw roll 85 and, in the friction milling chamber 90, milled still more under the milling action by the friction type milling roll 86 which is being rotated. The grains having been milled in the friction milling chamber 90 are discharged through the discharge port 92 to the outside of the machine against the pressing force of the resistance board 94.

In the conventional milling machine 81 described above, resistance board is provided only at the discharge port 92 of the friction milling part constituting the second milling part, while a discharge part of the abrasive milling part constituting the first milling part is substantially completely communicated with a supply part of the friction milling part constituting the second milling part, and therefore, it is impossible to adjust the degrees of milling or whitening in two milling parts independently.

Further, in the conventional horizontal milling machine 81 described above, since the abrasive milling roll 84 and the friction type milling roll 86 are mounted on one shaft 82, a diameter of the abrasive milling roll 84 is made larger than that of the friction type milling roll 86. This is for the purpose of making peripheral speed of the abrasive milling roll 84 larger than that of the friction type milling roll 86. However, in the above horizontal milling machine, it is structurally difficult to provide uniform contact of the grains with the abrasive milling roll over the whole circumference thereof when the diameter of the abrasive milling roll is increased, and the limit of its diameter is about 30 cm. Accordingly, there is a limit in increase of the size of the machine 81, making it difficult to enhance milling capacity drastically.

SUMMARY OF THE INVENTION

The present invention aims to solve at least a part of the above-described disadvantages of the conventional milling machine.

An object of the present invention is to provide a milling machine in which degree of milling or whitening of grain can be easily adjusted.

Another object of the present invention is to provide a milling machine in which milling roll can be increased in size and milling capacity can be enhanced.

According to the present invention, at least a part of the above object can be achieved by a vertical milling machine comprising: a first milling part; and a second milling part situated under said first milling part, the first and second milling parts having or sharing a common main shaft extending vertically, wherein the first milling part has a supply part of grain on an upper end side thereof and a discharge part of grain having been milled in said first milling part on a lower end side thereof, the second milling part has a supply part of grain to be milled in said second milling part on a lower end side thereof and a discharge part of grain having been milled in said second milling part on an upper end side thereof, and the grain discharge part of the first milling part is communicated with the grain supply part of the second milling part through a grain transfer passage extending therebetween.

Since the milling machine of the present invention is a vertical milling machine, size of the milling roll constituting the milling part can be increased easily.

Further, in the milling machine of the invention, since the grain supply part of the lower second milling part is provided on the lower end side of the second milling part, or since the grain transfer passage communicates the grain discharge part of the first milling part with the grain supply part of the second milling part on the lower end side thereof, resistance means for adjusting the degree of milling (degree of whitening) in the first milling part can be disposed in the grain transfer passage (including the grain discharge part of the first milling part), and accordingly, the degrees of milling (degrees of whitening) in the first and second milling parts can be individually adjusted without difficulty.

More specifically, grain supplied to the grain supply part at the upper end of the first milling part flows downward to the grain discharge part at the lower end thereof as being milled in the first milling part, and is then supplied from the grain discharge part of the first milling part to the grain supply part of the second milling part. Since the grain supply part of the second milling part situated under the first milling part is provided at the lower end of the second milling part, it is possible to have a sufficient length of grain transfer passage between the grain discharge part of the first milling part and the grain supply park of the second milling part, and an enough space can be provided at for example the upper end of the grain transfer passage or at the grain discharge part of the first milling part, and accordingly, by disposing in this space resistance means for adjusting pressing force applied to the grain in the first milling part, the degree of milling in the first milling part can be adjusted. Grain sent to the grain supply part of the second milling part is sent upwards as being milled in the second milling part and discharged from the grain discharge part at the upper end of the second milling part. The degree of milling of grain in the second milling part can be adjusted by disposing resistance means for adjusting pressing force applied to the grain in the second milling part at the grain discharge part at the upper end of the second milling part.

Further, according to the milling machine of the present invention, since a plurality of milling parts are disposed in or on one milling machine frame, i.e. one frame, installation area of the whole milling machine can be reduced and manufacturing cost of the milling machine can be reduced.

In the milling machine of the present invention, it is preferred that the first milling part is provided at the grain discharge part thereof with a first resistance means for adjusting degree of milling of grain in the first milling part, and the second milling part is provided at the grain discharge part thereof with a second resistance means for adjusting degree of milling of grain in the second milling part.

In this case, since the degrees of milling in the first and second milling parts can be individually adjusted without difficulty by the first and second resistance means, respectively, milling of grain can be performed in the condition that the milling machine is optimized to make the first and second milling parts fulfil their respective milling (whitening) functions at the best.

According to a preferred embodiment of the present invention, the first milling part comprises a first milling roll mounted on an upper part of the main shaft and a first bran-removing, perforated generally cylindrical body cooperating with the first milling roll to form a first milling chamber, and the second milling part comprises a second milling roll mounted on a lower part of the main shaft and a second bran-removing, perforated generally cylindrical body cooperating with the second milling roll to form a second milling chamber.

Grain supplied from the grain supply part of the first milling part to the first milling chamber is milled by the milling (whitening) action of the rotating first milling roll as it is sent downwards in the first milling chamber. The grain thus milled is further sent from the grain discharge part of the first milling part to the grain supply part of the second milling part through the grain transfer passage and, in the second milling chamber, milled by the milling action of the rotating second milling roll as it is sent upwards, and thereafter, discharged from the grain discharge part at the upper end of the second milling chamber to the outside of the milling machine. Powdered substance such as bran produced at the time of milling (whitening) grain in the first and second milling chambers is discharged through perforations of the first and second bran-removing, perforated cylindrical bodies, respectively, to the outside of the milling chambers so as to be collected.

According to a preferred embodiment of the present invention, the first milling roll is composed of one of abrasive milling roll and friction milling roll, and the second milling roll is composed of one of abrasive milling roll and friction milling roll.

In case that the milling roll is composed of abrasive milling roll, grain is milled by abrasive milling.(whitening) action of the rotating abrasive milling roll with respect to the grain, while in case that the milling roll is composed of friction type milling roll, grain is milled by friction milling (whitening) action of the rotating friction type milling roll with respect to the grain. Combination of abrasive milling roll and/or friction milling roll is selected in accordance with various factors such as kind and surface layer condition of grain to be milled, and condition of grain to be obtained by milling.

According to a preferred embodiment of the invention, the grain transfer passage extends generally vertically downwards from the grain discharge part of the first milling part to the grain supply part of the second milling part The foregoing and other objects, features and advantages of the invention will be made more apparent from description hereafter of preferred embodiments referring to attached drawings.

DETAILED DESCRIPTION OF PREFERRED EMBODIMENTS

Figure 1:
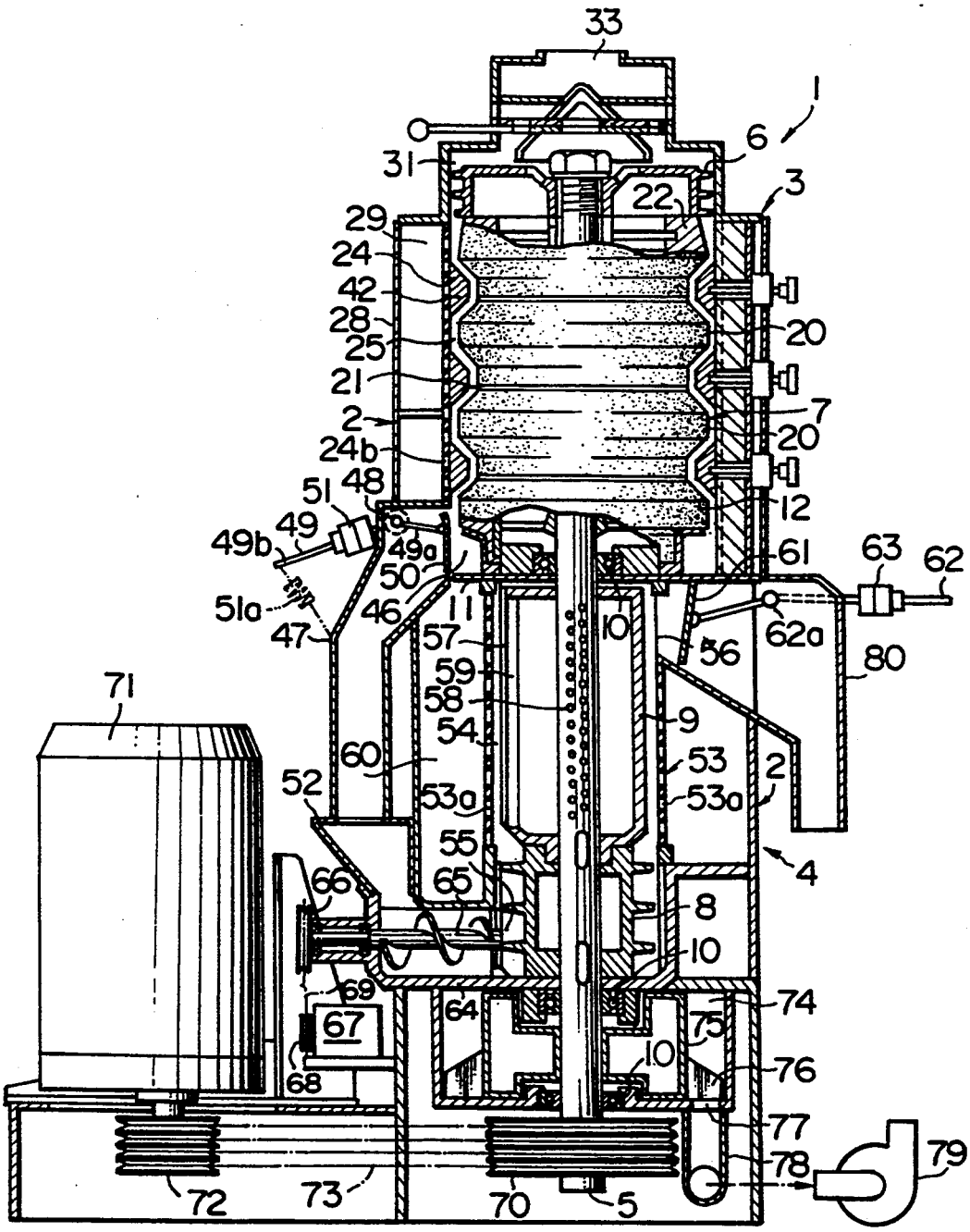
FIG. 1 is a vertical sectional view of a vertical milling machine according to a preferred embodiment of the invention.
Figure 2:
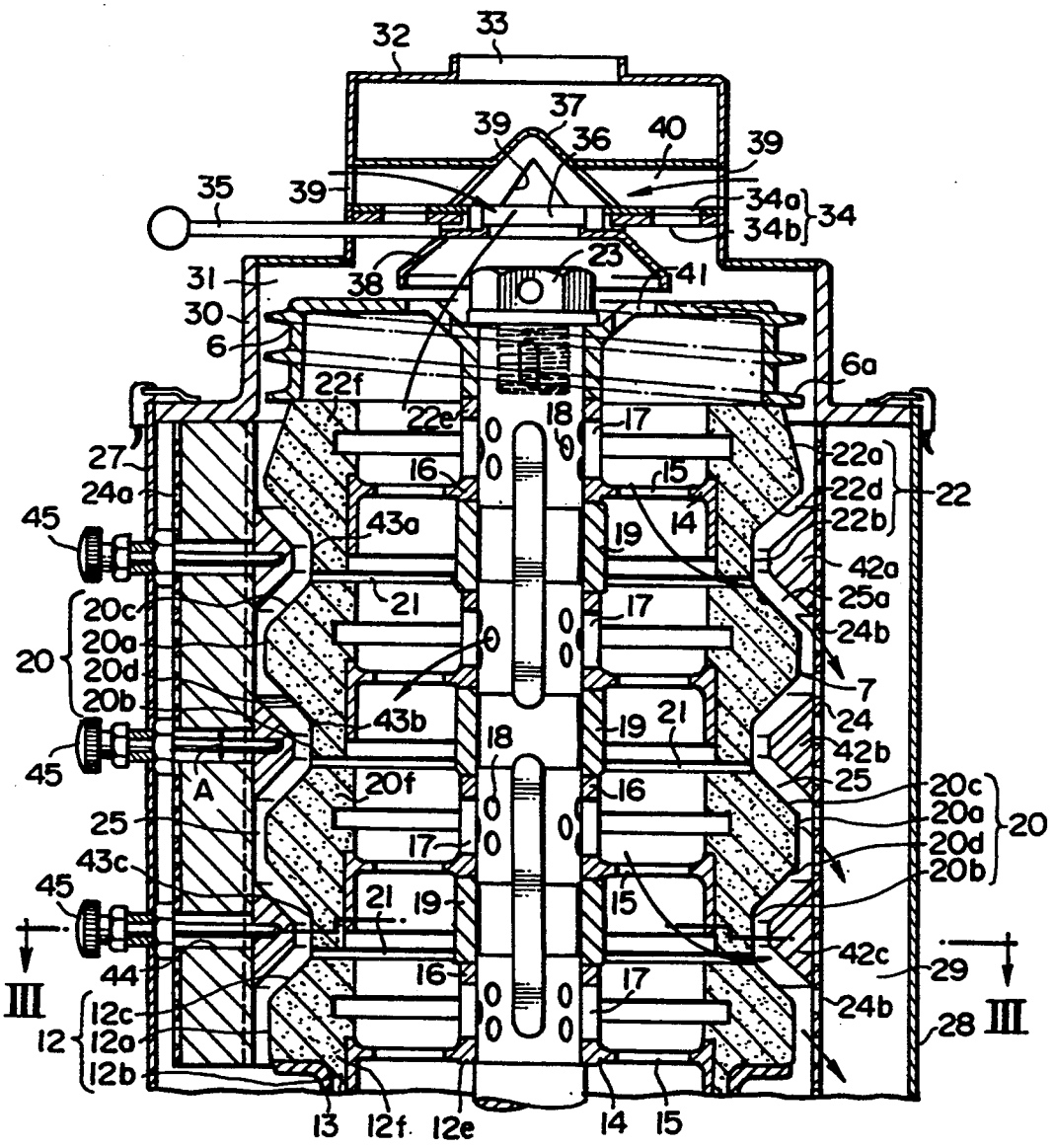
FIG. 2 is an enlarged sectional view of a part of FIG. 1, and corresponding to a section along a line II—II of FIG. 3.
Figure 3:
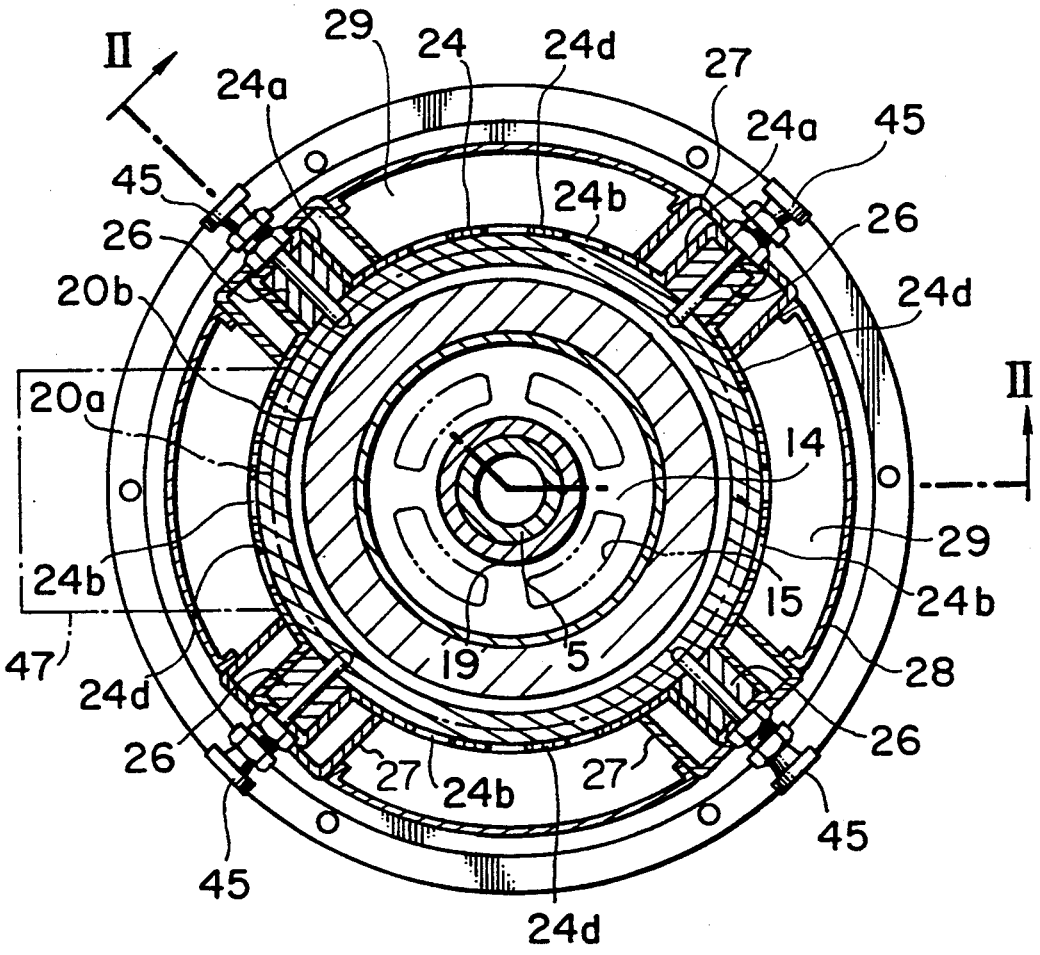
FIG. 3 is a cross-sectional view of FIG. 2 along a line III—III of FIG. 2.

In FIGS. 1–3, a vertical milling machine 1 comprises an abrasive milling part 3 as the first milling part disposed in an upper part of a machine frame 2 and a friction milling part 4 as the second milling part disposed in a lower part of the machine frame 2. A hollow main shaft 5 with an opening at its lower end is rotatably attached to the machine frame 2 through bearing portions 10, 10, 10. The main shaft 5 extends vertically. A screw roll 6 and an abrasive milling roll 7 as the first milling roll are mounted on an upper part of the main shaft 5, while a screw roll 8 and a friction type milling roll 9 as the second milling roll are mounted on a lower part of the main shaft 5.

In this milling machine 1, since a plurality of milling parts 3, 4 are formed in one machine frame 2, area for installation of the whole milling machine can be reduced and manufacturing cost thereof can be reduced significantly.

First, description will be given of detailed construction of the abrasive milling part 3. In FIG. 1, a rotary bottom member 11 is fixed to the main shaft 5, and a lowermost abrasive milling or whitening roll element 12 fitted on the main shaft 5 is set on and fixed to the rotary bottom member 11 through a setting ring 13. The lowermost abrasive milling roll element 12 comprises a large diameter portion **12*a*, a small diameter portion 12*b* and an upper inclined portion 12*c*** as shown in FIG. 2.

The lowermost abrasive milling roll element 12 is supported at a side step portion thereof by the setting ring 13 with flange portion as shown in FIGS. 1 and 2. An inner peripheral wall of the setting ring 13 is fitted on a small diameter portion of the lowermost abrasive milling roll element 12.

The lowermost abrasive milling roll element 12 comprises an inner support part 12*e* made of metal and an outer abrasive part 12*f* made of abrasive emery particles. The inner support part 12*e* comprises a boss portion 16 having therein round holes 17 and a plurality of arms 14 between which openings 15 are formed. The holes 17 of the boss portion 16 are communicated with blast air holes 18 of the hollow main shaft 5 on which the boss portion 16 is fitted.

A collar 19 fitted on the shaft 5 is set on the lowermost abrasive milling roll element 12. On the collar 19 is set on a boss portion 16 of an intermediate abrasive milling roll element 20 having on the whole almost the same structure as the lowermost abrasive milling roll element 12. In the intermediate abrasive milling roll element 20 as well, the boss portion 16 is formed with round holes 17 communicating with the blast air holes 18 of the hollow main shaft 5, and openings 15 are formed between arms 14 thereof (FIGS. 2 and 3). The intermediate abrasive milling roll element 20, more specifically, an outer abrasive part 20*f* thereof comprises a large diameter portion 20*a*, a small diameter portion 20*b*, a lower inclined portion 20*d* therebetween and a downwardly divergent upper inclined portion 20*c* formed above the large diameter portion 20*a*. Between the lower end of the small diameter portion 20*b* of the intermediate abrasive milling roll element 20 and the upper end of the lowermost abrasive milling roll element 12 is formed a gap 21 for jet air.

On the boss portion 16 of the intermediate abrasive milling roll element 20 is set another collar 19 fitted on the shaft 5. On this collar 19 is set a boss portion 16 of another intermediate abrasive milling roll element 20 fitted on the shaft 5. This intermediate abrasive milling roll element 20 has the same structure as the intermediate abrasive milling roll element 20 on the lowermost abrasive milling roll element 12. Namely, this intermediate abrasive milling roll element 20, more specifically, an outer abrasive part 20*f* thereof comprises a large diameter portion 20*a*, a small diameter portion 20*b*, an upper inclined portion 20*c* and a lower inclined portion 20*d*, and a gap 21 for jet air is formed between the lower end of this small diameter portion 20*b* and the upper end of the lower intermediate abrasive milling roll element 20 on the lowermost abrasive milling roll element 12. On the boss portion 16 of the upper intermediate abrasive milling roll element 20 is set still another collar 19 fitted on the shaft 5. On this collar 19 is set a boss portion 16 of an uppermost abrasive milling roll element 22 fitted on the shaft 5.

In this embodiment, two intermediate abrasive milling roll elements 20 are equipped, and however, the number of the intermediate abrasive milling roll elements 20 to be equipped through collar or spacer 19 may be one or not smaller than three. Further, under certain circumstances, the intermediate abrasive milling roll element 20 may be dispensed with.

The uppermost abrasive milling roll element 22 comprises an inner support pare 22*e* made of metal and an outer abrasive part 22*f* made of abrasive emery particles. The inner support part 22*e* comprises the boss portion 16 having round holes 17 and a plurality of arms 14 between which openings 15 are formed. The holes 17 of the boss portion 16 are communicated with the blast air holes 18 of the hollow main shaft 5 formed in the vicinity of the upper end thereof, on which shaft 5 is fitted the boss portion 16. The outer abrasive part 22*f* of the uppermost abrasive milling roll element 22 comprises a downwardly slightly divergent or circular truncated cone-shaped large diameter portion 22*a*, a small diameter portion 22*b* and a lower inclined portion 22*d* between the large diameter portion 22*a* and the small diameter portion 22*b*, and a gap 21 for jet air is formed between the upper end of the small diameter portion 22*b* and the upper end of the another intermediate abrasive milling roll element 20 situated just therebelow.

On the boss portion 16 of the uppermost abrasive milling roll element 22 is set a boss portion of the aforesaid bottomless hollow screw roll 6 fitted on the shaft 5. The screw roll 6 is formed on the outer periphery thereof with a feed screw 6*a*. The screw roll 6 is pressed on and fixed to the uppermost abrasive milling roll element 22 by means of a bolt 23 screwed to the upper end of the hollow main shaft 5.

Around the large diameter portions 12*a*, 20*a*, 22*a* of the lowermost abrasive milling roll element 12, intermediate abrasive milling roll elements 20 and uppermost abrasive milling roll element 22 is disposed a bran-removing, generally cylindrical perforated body 24 leaving a small space between them, so that an abrasive milling chamber 25 as the first milling chamber is formed between the bran-removing cylindrical perforated body 24 and the abrasive milling roll elements 12, 20, 22 (FIGS. 2 and 3). More specifically, the bran-removing, generally cylindrical perforated body 24 comprises four divided parts 24*d* each supported at both side edges thereof by associated two of four stanchions 26 provided upright around the abrasive milling roll elements 12, 20, 22. Each stanchion 26 is covered with a stanchion cover 27 of a U-letter form cross-section. A bran-removing chamber cover 28 of an arcuate cross-section is disposed between each circumferentially adjacent stanchion covers 27, 27, the cover(s) 28 cooperating with Corresponding bran-removing cylindrical perforated body 24 or divided parts 24*d* thereof to form a bran-removing chamber 29.

A diameter of the large diameter portions 12*a*, 20*a*, 22*a* of the abrasive milling roll elements 12, 20, 22 which depends on amount of grains to be milled per unit period of time is about 40–50 cm for about 8 tons/hr. Since the milling machine 1 of this embodiment is of the vertical shaft type that the main shaft 5 extends vertically, it is possible to increase the outer diameter of the abrasive milling roll 7 or the elements thereof, as compared with the case of the horizontal type machine.

On the stanchions 26 is set on and fixed to a feed cylinder 30 surrounding the screw roll 6 and having a supply port 31 at the upper end thereof. A hopper cylinder 32 having a charging port 33 at the upper end thereof is fixed to the upper end of the supply port 31. In the hopper cylinder 32 is provided a grain feed amount regulating mechanism 34 comprising a fixed plate 34*a* with a plurality of openings and a rotary plate 34*b* with a plurality of openings and rotatable by a regulating lever 35. An opening 36 is formed through the central portion of the fixed plate 34*a* and rotary plate 34*b*. A hollow bottomless conical upper guide member 37 is disposed above the opening 36, while a lower guide member 38 of a circular truncated cone shape is disposed below the opening 36. Further, induction pipes 40 are provided for taking atmospheric air into the upper guide member 37 through a plurality of air inlet ports 39 formed circumferentially equidistantly in a peripheral wall of the hopper cylinder 32. The screw roll 6 is formed in an upper wall surface thereof with vent holes 41 in the positions below the lower guide member 38.

In addition, the bran-removing cylindrical perforated body 24 is provided on an inner peripheral surface thereof with resistance rings 42*a*, 42*b*, 42*c*. More specifically, the resistance ring 42*a* is so provided as to protrude into a trough portion 43*a* formed by the lower inclined portion 22*d* and small diameter portion 22*b* of the uppermost abrasive milling roll element 22 and the upper inclined portion 20*c* of the intermediate abrasive milling roll element 20 situated just below the element 22, the resistance ring 42*b* is so provided as to protrude into a trough portion 43*b* formed by the lower inclined portion 20*d* and small diameter portion 20*b* of the intermediate abrasive milling roll element 20 and the upper, inclined portion 20*c* of the other intermediate abrasive milling roll element 20 just therebelow, and the resistance ring 42*c* is so provided as to protrude into a trough portion 43*c* formed by the lower inclined portion 20*d* and small diameter portion 20*b* of the lower intermediate abrasive milling roll element 20 and the upper inclined portion 12*c* of the lowermost abrasive milling roll element 12.

As is obvious from FIG. 2, the sectional shape of the resistance rings 42*a* to c is nearly similar to that of the trough portions 43*a* to *c*, and the milling chamber 25 formed between the resistance rings 42*a* to *c* and the trough portions 43*a* to *c* becomes a meandering milling chamber 25*a* meandering from top to bottom.

Each of the resistance rings 42*a* to *c* is pressed on and fixed to the inner peripheral surface of the bran-removing cylindrical perforated body 24 by knob bolts 45 inserted in through-holes 44 of the respective stanchions 26. Since an inner diameter A of the hole 44 is considerably larger than the diameter of the knob bolt 45, the knob bolt 45 is vertically displaceable with respect to the stanchion 26 by an amount corresponding to this difference in diameter, making it possible to adjust vertical attaching positions of the resistance rings 42*a* to *c* and adjust a resistance with respect to the flow of grains in the meandering milling chamber 25*a*.

A discharge port 46 is formed at the lower end of the abrasive milling chamber 25, and a discharge chute 47 is provided below the discharge port 46. A horizontal shaft 48 is attached to the discharge chute 47, and a weighted lever 49 comprising arm portions 49*a*, 49*b* is attached to the horizontal shaft 48 so as to be rotatable about the horizontal shaft 48 with respect to the discharge chute 47. A resistance board 50 capable of closing the discharge port 46 is rotatably attached to a distal end of the arm portion 49*a* of the weighted lever 49, while a weight 51 is set on the arm portion 49*b* of the weighted lever 49 so as to be displaceable in the longitudinal direction of the arm portion 49*b*. In this embodiment, the resistance means capable of adjusting the pressing force applied to the grains in the milling chamber 25 and hence the degree of milling of the grains in the abrasive milling chamber 25 comprises the shaft 48, weighted lever 49, resistance board 50 and weight 51. Meanwhile, the grain discharge part comprises the discharge port 46 and discharge chute 47 which also serves as the transfer passage. The discharge chute 47 is communicated with a supply chute 52 of a friction milling part 4. Means for adjusting the pressing force applied to the resistance board 50 may be any force adjusting means in place of a combination of the lever 49 and displaceable weight 51.

Further, as shown by imaginary lines in FIG. 1, an elastic means 51*a* such as tension or expansion spring may be provided between the weighted lever 49 and the discharge chute 47. Under certain circumstances, elastic force of the elastic means 51*a*, such as modulus of elasticity or elastic coefficient may be made adjustable. For example, in the latter case, the weight may be dispensed with.

Next, description will be given of the friction milling part as second milling part. The friction milling part 4 comprises the screw roll 8 mounted on the hollow main shaft 5 in the vicinity of the lower end thereof, the friction type milling roll 9 mounted on a lower part of the hollow main shaft 5 to be situated above the screw roll 8, and a bran-removing cylindrical perforated body 53 extending vertically around the friction type milling roll 9 so as to form a friction milling chamber 54. The friction milling chamber 54 is communicated with a supply port 55 at a lower end thereof and with a discharge port 56 approximately at an upper end thereof. The friction type milling roll 9 stirs the grains in the friction milling chamber 54 by means of a stirring projection 57 provided thereto, making the grains rub each other. The hollow main shaft 5 is formed with a large number of vent holes 58 which are communicated with the friction milling chamber 54 and a bran-removing chamber 60 through blast air holes 59 of the friction type milling roll 9. The friction milling machine itself has been known as disclosed in for example U.S. Pat. No. 4,843,957, which is incorporated herein by this reference thereto.

A resistance board 61 for adjusting the degree of milling of grain is provided at the discharge port 56. By adjusting the position of a weight 63 set on a weighted lever 62 rotatable about a horizontal shaft 62*a* like the weighted lever 49, the degree of milling of the grains in the friction milling chamber 54 can be adjusted. A discharge chute 80 is communicated with the discharge port 56, while a conveyor trough 64 is communicated with the supply port 55. A horizontally extending screw conveyor 65 is provided in the conveyor trough 64, and a pulley 66 is attached to one end of the conveyor 65. Between the pulley 66 and a pulley 68 attached to an electric motor 67 is stretched a belt 69, while between a pulley 70 attached to the hollow main shaft 5 and a pulley 72 attached to a main electric motor 71 is stretched a belt 73.

Below the bran-removing chamber 60 is formed a bran-collecting chamber 74 communicated with the bran-removing chamber 60. A plurality of scraping blades 76 formed on an outer peripheral surface of a blade setting cylinder 75 mounted on the main shaft 5 are positioned in the bran-collecting chamber 74. A bran discharge port 77 is formed in the bottom of the bran-collecting chamber 74, and a bran-collecting fan 79 is connected to a distal end of an exhaust pipe 78 extending from the bran discharge port 77. The bran-removing chamber 60 of the friction milling part 4 is communicated with the bran-removing chamber 29 of the abrasive milling part 3, and the bran-collecting chamber 74 is communicated with the bran-removing chamber 29 through the bran-removing chamber 60.

In the milling machine 1 of this embodiment, since the supply port 55 of the friction milling part 4 as the lower and second milling part is provided at the lower end of the friction milling part 4, it is easy to provide at the discharge port 46 of the abrasive milling part 3 as the upper and first milling part a space room large enough to attach the resistance means 46 to 51 for adjusting the degree of milling of the grains in the abrasive milling part 3. Accordingly, the degree of milling or whitening of the grains in the abrasive milling part 3 can be adjusted by the resistance means independently of the degree of milling or whitening of the grains in the friction milling part 4, thereby facilitating fine or delicate adjustment of the degree of whitening of grain.

Now, operation of the vertical milling machine 1 according to a preferred embodiment of the present invention, which is constructed as described above, will be described taking a case of milling rice grain as an example of cereal grain. The cereal grain to be milled may be wheat grain or other cereal grain in place of rice grain.

Prior to commencement of milling, vertical positions of the resistance members 42*a* to *c* are adjusted by making use of the knob bolts 45 to adjust the resistance with respect to the flown-down of the rice grains. Further, by adjusting the position of the weight 51 on the arm portion 49*b* of the lever 49, the force with which the resistance board 50 attached to the distal end of the arm portion 49*a* of the lever 49 closes the discharge port 46 or the pressing force which the resistance board 50 should apply to the rice grains at the discharge port 46, that is, the pressure applied to the rice grains in the abrasive milling chamber 25 or the condition of the rice grains filled in the abrasive milling chamber 25 or, in other words, the degree of milling or whitening is adjusted. In the same manner, by adjusting the position of the weight 63 on the lever 62, the force with which the resistance board 61 attached to the distal end of the lever 62 closes the discharge port 56 or the pressing force which the resistance board 61 should apply to the rice grains at the discharge port 56, that is, the pressure applied to the rice grains in the friction milling chamber 54 or the condition of the rice grains filled in the friction milling chamber 54 or, in other words, the degree of whitening is adjusted independently of the degree of whitening in the abrasive milling chamber 25. If desired, the respective pressing forces of the resistance boards 50, 61 or the respective degrees of whitening in the abrasive milling chamber 25 and the friction milling chamber 54 may be adjusted by the weights 51, 63 during the milling or whitening.

As the main motor 71 is started, the screw roll 6, the abrasive milling roll 7, the screw roll 8 and the friction type milling roll 9 are rotated through the hollow main shaft 5 and, as the motor 67 is started, the screw conveyor 65 is rotated. Further, the bran-collecting fan 79 is started.

Raw material rice grains supplied through a chute (not shown) to the charging port 33 or the rice grains to be milled by the milling machine 1 flow down as being dispersed uniformly in the circumferential direction by the upper guide member 37 and fall into the supply port 31 at an appropriate flow rate adjusted by the regulating lever 35.

The rice grains having fallen in the supply port 31 are fed successively into the abrasive milling chamber 25 by means of the screw roll 6. The rice grains in the abrasive milling chamber 25 actively flow, that is, revolve (rotate around the main shaft 5) and roll or rotates under a relatively low pressure or under the condition that they push to each other with a relatively small pressing force, while being rubbed with the peripheral surfaces of the uppermost, intermediate and lowermost abrasive milling roll elements 22, 20, 20 and 12 of the abrasive milling roll 7, so that surface layers thereof are abraded. More specifically, while the rice grains flow down from the downwardly slightly divergent upper inclined portion 22*a* of the uppermost abrasive milling roll element 22 through the upper part of the meandering milling chamber 25*a* formed by the trough portion 43*a* and the resistance ring 42*a*, they repeat rolling and revolving actively, resulting in that the surface of each rice grain is abraded substantially all over. When the rice grains pass through the meandering milling chamber 25*a*, they move from around the bran-removing cylindrical perforated body 24 toward the abrasive milling roll 7 or, conversely, from around the abrasive milling roll 7 toward the bran-removing cylindrical perforated body 24, and accordingly, the rice grains in the milling chamber 25 can have increased chances of contact with the peripheral surface of the milling roll 7.

In this way, the rice grains flow down through the upper part of the meandering milling chamber 25*a* defined by the trough portion 43*a* and the resistance ring 42*a* while stagnating temperately. The extent of stagnation, the average flowing-down speed and the like depend on the magnitude of the pressing force applied by the resistance board 50. In a part of the abrasive milling chamber 25, defined between the large diameter portion 20*a* of the upper intermediate abrasive milling roll element 20 and the bran-removing cylindrical perforated body 24, the rice grains are subjected to the milling action by the large diameter portion 20*a*, while bran having been removed from the surfaces of the rice grains is discharged through perforations 24*b* of the bran-removing cylindrical perforated body 24 to the bran-removing chamber 29.

Meanwhile, owing to the suction by the bran-collecting fan 79, atmospheric air coming in through the air inlet ports 39 of the hopper cylinder 32 passes through the induction pipes 40, the openings of the upper guide chamber 37, the inside of the lower guide member 38, the vent holes 41 of the screw roll 6 and the openings 15 in the abrasive milling roll elements 22, 20, 20 and 12, and then jets into the abrasive milling chamber 25 through the jet-air gaps 21 between the adjacent abrasive milling roll elements, and accordingly, removal of the bran from the milling chamber 25 can be enhanced and stirring of the rice grains in the milling chamber 25 can be promoted and, moreover, an excessive rise of temperature of the rice grains can be suppressed. Further, owing to the suction by the bran-collecting fan 79, atmospheric air is also sucked from the lower end of the hollow main shaft 5 and, after passing through the air holes 18 of the main shaft 5 and the holes 17 of the boss portions 16, jotted into the abrasive milling chamber 25 through the jet-air gaps 21 between the adjacent abrasive milling roll elements. The atmospheric air to be jotted into the milling chamber 25 through the jet-air gaps 21 may be taken in from merely one of the air inlet ports 39 of the hopper cylinder 32 and the lower end of the hollow main shaft 5.

In this way, the rice grains having been milled uniformly spending a proper stagnation time in the milling chamber 25 pass through around the small diameter portion 12*b* of the lowermost abrasive milling roll element 12 and are then discharged through the discharge port 46 against the resistance board 50 and, further flow down through the discharge chute 47 to be supplied or transferred to the supply chute 52 of the friction milling part 4. On the other hand, the bran having been discharged into the bran removing chamber 29 passes through the bran-removing chamber 60 of the friction milling part 4 and is then discharged by the suction of the bran-collecting fan 79 via the bran-discharge port 77 of the bran-collecting chamber 74 and the exhaust pipe 78.

The rice grains supplied to the supply chute 52 of the friction milling part 4 are sent to the screw roll 8 by means of the screw conveyor 65 and further sent upwards to the friction milling chamber 54 by means of the screw roll 8. In the friction milling chamber 54, the rice grains rub each other under the action of the rotating friction type milling roll 9 so as to be further milled or whitened due to the friction milling action. Namely, the rice grains are milled to a desired degree of milling or whitening according to the friction milling effect between the rice grains of a magnitude depending on the pressing force applied at the discharge port 56 by the resistance board 61. Since the surface layers of the rice grains to be milled in the friction milling chamber 54 have already been abraded by the abrasive milling roll 7, the coefficient of friction is increased, and accordingly, removal of the surface bran layers of the rice grains by the friction type milling roll can be performed effectively and sufficiently.

Further, owing to the air flow, due to the suction by the bran-collecting fan 79, jetting through the air holes 59 from the vent holes 58, bran is removed from the friction milling chamber 54. Namely, fine powder such as bran produced by the whitening action in the friction milling chamber 54 is discharged through the holes 53*a* of the bran-removing cylindrical perforated body 53 to the bran removing chamber 60 together with bran-removing air and, further, discharged through the bran discharge port 77 of the bran-collecting chamber 74 and the exhaust pipe 78 owing to the suction by the bran collecting fan 79.

The rice grains having been whitened reach the discharge port 56 and flow out against the pressing force of the resistance board 61. The rice grains thus flown out flow further down through the discharge chute 80 so as to be discharged to the outside of the milling machine 1.

Figure 4:
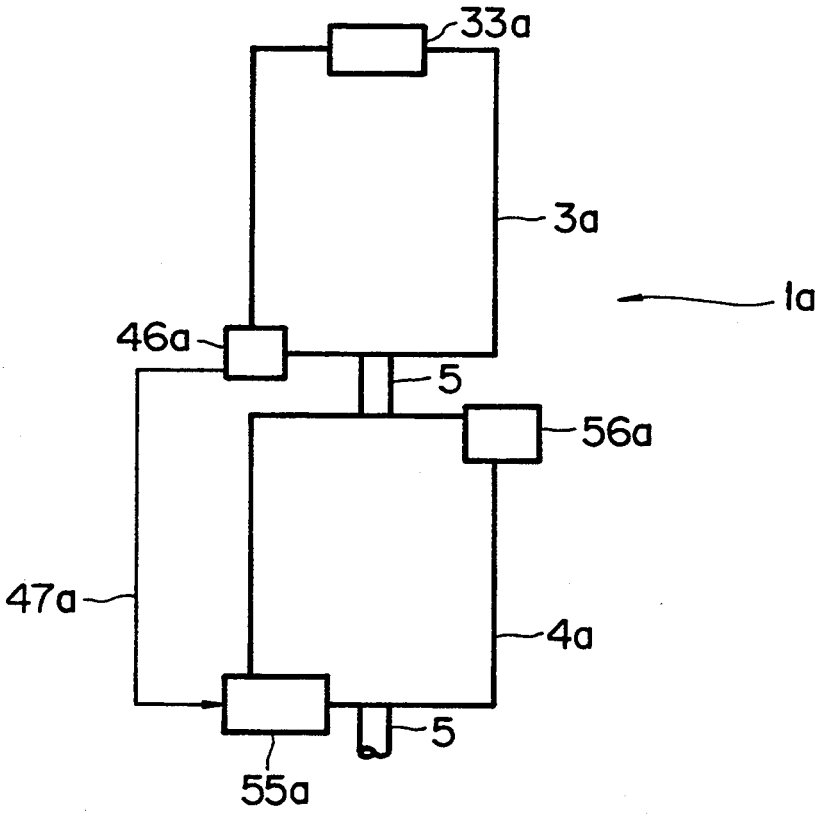
FIG. 4 is a diagrammatic view of possible alternatives of the first and second milling parts of the vertical milling machine.
Figure 5:
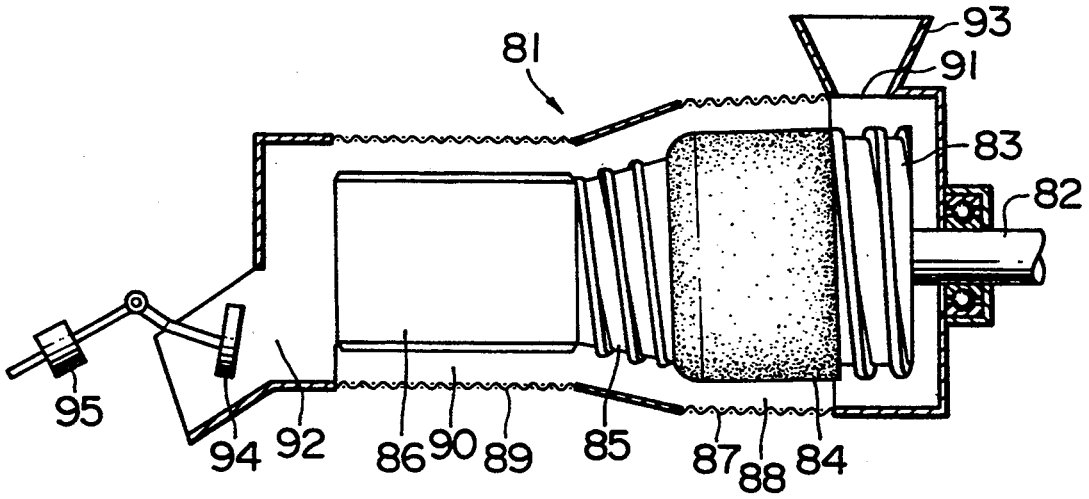
FIG. 5 is a sectional view of a conventional horizontal milling machine.

In the above embodiment, description has been made about the case that the first milling part is the abrasive milling part 3 and the second milling part is the friction milling part 4. However, as shown diagrammatically in FIG. 4, provided that a vertical milling machine la comprises a first milling part 3*a* having a grain supply part 33*a* on the upper end side thereof and a grain discharge part 46*a* on the lower end side thereof and a second milling part 4*a* having a grain supply part 55*a* which is communicated with the grain discharge part 46*a* of the first milling part 3*a* through a grain transfer passage 47*a*, on the lower end side thereof and a grain discharge part 56*a* on the upper end side thereof, and the first milling part 3*a* is situated on the upper end side of a vertical main shaft 5 and the second milling part 4*a* on the lower end side of the main shaft 5, both of the first and second milling parts 3*a*, 4*a* may be abrasive milling parts or friction milling parts and, further, the first milling part 3*a* may be a friction milling part and the second milling part 4*a* may be an abrasive milling part. It is noted that the discharge parts 46*a*, 56*a* are provided with individual resistance means for adjusting degree of whitening of grain in the first and second milling parts 3*a*, 4*a*, respectively.

Moreover, the abrasive milling part and/or the friction milling part shown in FIGS. 1–3 may be individually replaced by corresponding parts of an abrasive milling machine and/or a friction type milling machine such as those disclosed in U.S. Pat. Nos. 3,734,752, 3,960,068, 4,426,922, 4,459,903 and 4,829,893. For instance, the abrasive milling chamber may be composed of a simple cylindrical or annular milling chamber, in place of the meandering milling chamber 25*a*. Further, moisture-adding air may be induced into the friction milling chamber 54.

In addition, a plural vertical milling machines 1*a* may be disposed to be connected in series pass the rice grains through the plural machines.

What is claimed is:

1. A vertical milling machine comprising:
   a first milling part; and
   a second milling part situated under said first milling part,
   the first and second milling parts having a common main shaft extending vertically,
   wherein the first milling part has a supply part of grain on an upper end side thereof and a discharge part of grain having been milled in said first milling part on a lower end side thereof,
   the second milling part has a supply part of grain to be milled in the second milling part on a lower end side thereof and a discharge part of grain having been milled in the second milling part on an upper end side thereof, and
   the grain discharge part of the first milling part is communicated with the grain supply part of the second milling part through a grain transfer passage extending therebetween.

2. A milling machine according to claim 1, wherein the first milling part is provided at the grain discharge part thereof with a first resistance means for adjusting degree of milling of grain in the first milling part, and the second milling part is provided at the grain discharge part thereof with a second resistance means for adjusting degree of milling of grain in the second milling part.

3. A milling machine according to claim 2, wherein the first milling part comprises a first milling roll mounted on an upper part of the main shaft and a first bran-removing, perforated generally cylindrical body cooperating with the first milling roll to form a first milling chamber, and the second milling part comprises a second milling roll mounted on a lower part of the main shaft and a second bran-removing, perforated generally cylindrical body cooperating with the second milling roll to form a second milling chamber.

4. A milling machine according to claim 2, wherein the first milling roll is composed of one of abrasive milling roll and friction milling roll, and the second milling roll is composed of one of abrasive milling roll and friction milling roll.

5. A milling machine according to claim 1, wherein the grain transfer passage extends generally vertically downwards from the grain discharge part of the first milling part to the grain supply part of the second milling part.

* * * * *